US008676412B2

(12) United States Patent
Pereira

(10) Patent No.: US 8,676,412 B2
(45) Date of Patent: Mar. 18, 2014

(54) REACTIVE SUSPENSION WITH AN INTEGRATED BRAKING AND STEERING SYSTEM FOR A BOAT

(76) Inventor: Fred Pereira, Las Vegas, NV (US)

( * ) Notice: Subject to any disclaimer, the term of this patent is extended or adjusted under 35 U.S.C. 154(b) by 533 days.

(21) Appl. No.: 12/592,904

(22) Filed: Dec. 3, 2009

(65) Prior Publication Data

US 2010/0138084 A1 Jun. 3, 2010

Related U.S. Application Data

(60) Provisional application No. 61/200,682, filed on Dec. 3, 2008.

(51) Int. Cl.

| | |
|---|---|
| ***B60L 3/00*** | (2006.01) |
| ***B60L 15/00*** | (2006.01) |
| ***G05D 1/00*** | (2006.01) |
| ***G05D 3/00*** | (2006.01) |
| ***G06F 7/00*** | (2006.01) |
| ***G06F 17/00*** | (2006.01) |

(52) U.S. Cl.
USPC ..... 701/21; 701/36; 701/37; 114/271; 114/279; 114/284

(58) Field of Classification Search
USPC ..... 701/21, 36, 37; 114/55.5, 55.54, 271, 114/279, 284
See application file for complete search history.

(56) References Cited

U.S. PATENT DOCUMENTS

| | | | | |
|---|---|---|---|---|
| 3,517,632 | A * | 6/1970 | Gray | 114/283 |
| 4,351,262 | A * | 9/1982 | Matthews | 114/284 |
| 5,277,142 | A * | 1/1994 | Connor | 114/61.16 |
| 5,603,281 | A * | 2/1997 | Harvey et al. | 114/363 |
| 5,697,317 | A * | 12/1997 | Pereira | 114/55.52 |
| 6,620,003 | B2 * | 9/2003 | Mardikian | 440/38 |
| 6,763,774 | B1 * | 7/2004 | Ranieri et al. | 114/76 |
| 6,892,666 | B1 * | 5/2005 | Plante et al. | 114/363 |
| 7,874,882 | B2 * | 1/2011 | Sagov | 440/14 |
| 7,913,636 | B2 * | 3/2011 | Meyer | 114/283 |
| 7,946,237 | B2 * | 5/2011 | Fong et al. | 114/144 R |
| 2007/0139216 | A1 * | 6/2007 | Breed | 340/825.72 |
| 2007/0261625 | A1 * | 11/2007 | Hodge | 114/123 |
| 2008/0216728 | A1 * | 9/2008 | Hofbauer | 114/39.25 |

FOREIGN PATENT DOCUMENTS

| | | | |
|---|---|---|---|
| WO | WO 2006035229 | A2 * | 4/2006 |
| WO | WO 2006038808 | A1 * | 4/2006 |

* cited by examiner

*Primary Examiner* — Rami Khatib
(74) *Attorney, Agent, or Firm* — Mark S. Hubert

(57) ABSTRACT

A boat with several stability and handling design improvements. It has an enhanced reactive suspension system positioned in the vessel between a set of separating hull and body components. The boat also has improved braking, steering and stabilizing systems designed around multiple pivoting mechanisms on the vessel hull that work individually or in unison to achieve the desired braking or steering effect. The stabilizing system is operated by a computerized, gyroscopic hydraulic control to maintain stability and comfort of ride, minimizing the roll, pitch and yaw commonly experienced in the passenger compartment.

10 Claims, 12 Drawing Sheets

6A 6B 6C 7A 7B 7C

REACTIVE SUSPENSION WITH AN INTEGRATED BRAKING AND STEERING SYSTEM FOR A BOAT

Applicant claims priority of U.S. Provisional Patent Application Ser. No. 61/200,682 entitled "Watercraft Stabilization System", filed Dec. 3, 2008, and incorporates by reference all material therein.

BACKGROUND OF THE INVENTION

The present invention relates to an improved suspension system integrated with a steering and braking system adapted to ensure that a smooth ride is experienced in the passenger compartment of a boat. More particularly, to a suspension system for a water vessel designed to provide, stability, comfort as well as enhanced performance and safety.

Heretofore, because of the inherent jostling of a water vessel motorized watersports such as boating have been for those who are not prone to motion sickness or have back disorders. This new invention utilizes and combines known and new technologies in a unique and novel configuration to overcome the aforementioned "jostling" problems and accomplish this.

SUMMARY OF THE INVENTION

The general purpose of the present invention, which will be described subsequently in greater detail, is to provide a boat with an enhanced suspension system that is able to stabilize the passenger compartment or seating area with respect to the motion of the hull and provide a level of comfort and minimized motion heretofore unknown in the water sport industry. This suspension system has many of the advantages mentioned heretofore and many novel features that result in a new boat suspension system which is not anticipated, rendered obvious, suggested, or even implied by any of the prior art, either alone or in any combination thereof.

An object of the present invention is to provide an improved boat suspension system that connects and resides between the vessel hull and vessel body and is capable of dramatically reducing the roll, pitch and yaw of the passenger compartment.

It is another object of this invention to provide an improved steering and braking system for a boat capable of meeting or exceeding all known standards for boat handling.

It is a further object of this invention to provide a boat adapted for use by persons prone to discomfort or injury as a result of excessive roll, pitch or yaw motions imparted to their bodies.

It is yet a further object of this invention to provide a boat with enhanced handling characteristics that are capable of meeting and exceeding all known standards for boat handling even as the boat becomes air-born and travels through the air as many high speed boats do when encountering large swells.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements. Other objects, features and aspects of the present invention are discussed in greater detail below.

DETAILED DESCRIPTION

Figure 1:
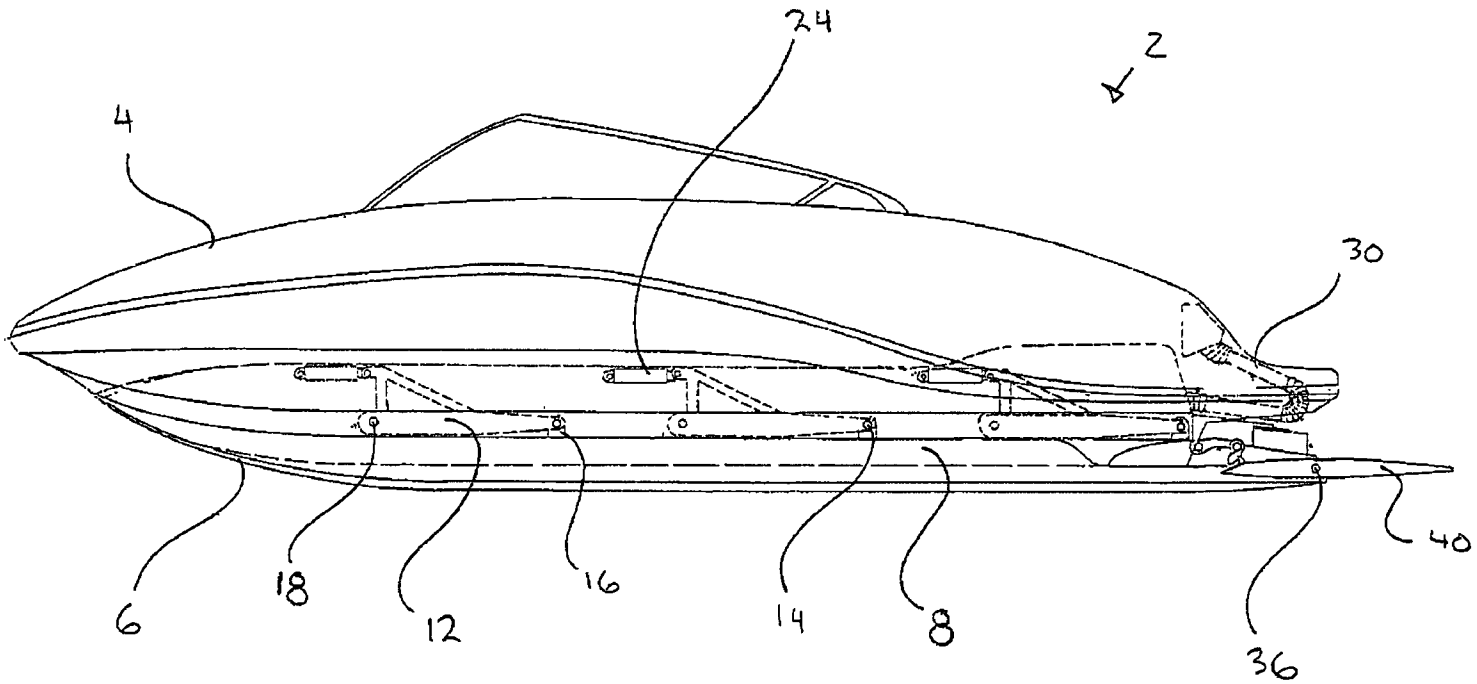
FIG. 1 is a side view of an inboard boat in the collapsed position showing the general arrangement of the suspension system components.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting. The present invention entails a boat suspension system integrated with a steering and braking system. These three systems commonly share a set of three hydraulic operated flaps (two elevons 40 and one elevator 42) that may be manipulated by manual or automatic control.

Figure 12:
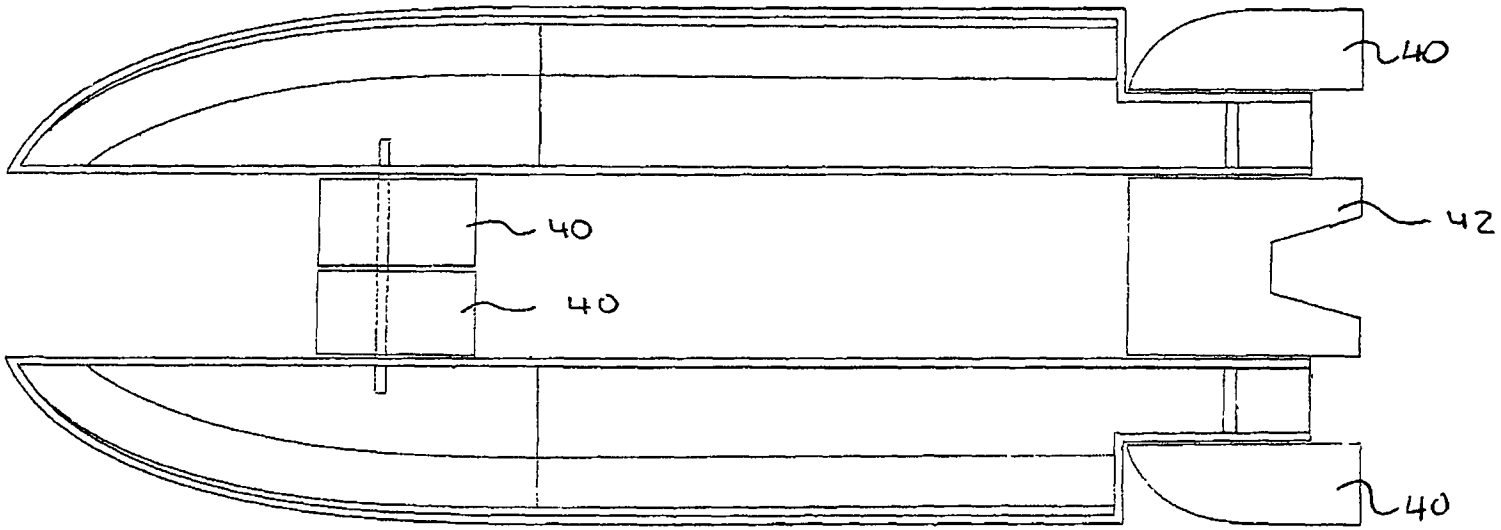
FIG. 12 is a top view of the bottom hull sponsons of a tunnel hull boat showing the optional front elevons.

Looking at FIGS. 1, 2, 3 and 4 it can be seen that the suspension system when activated to the extended configuration will cause the upper body 4 to separate from the lower hull 6 of a standard V hull boat 2. The body 4 rises vertically above and slightly aft of the hull with respect to their relative positions when in the contracted configuration. This reactive suspension and integrated braking and steering system is adaptable for most designs of boats whether they be inboard, inboard/outboard, outboard, as well as most of the common hull designs such as deep V, shallow V, flat bottom, tunnel, catamaran or tri hull. The suspension system is also designed to be adapted to any size or length of boat by simply adding more inner suspension modules to fit whatever length of boat is desired. FIGS. 8-11 show the same suspension system on a boat with an outboard engine. FIG. 12 shows the hull bottom configuration with the optional forward elevons 40. The suspension system in a tunnel boat differs mainly in the separation between the two parallel banks of reactive suspension components.

Figure 4:
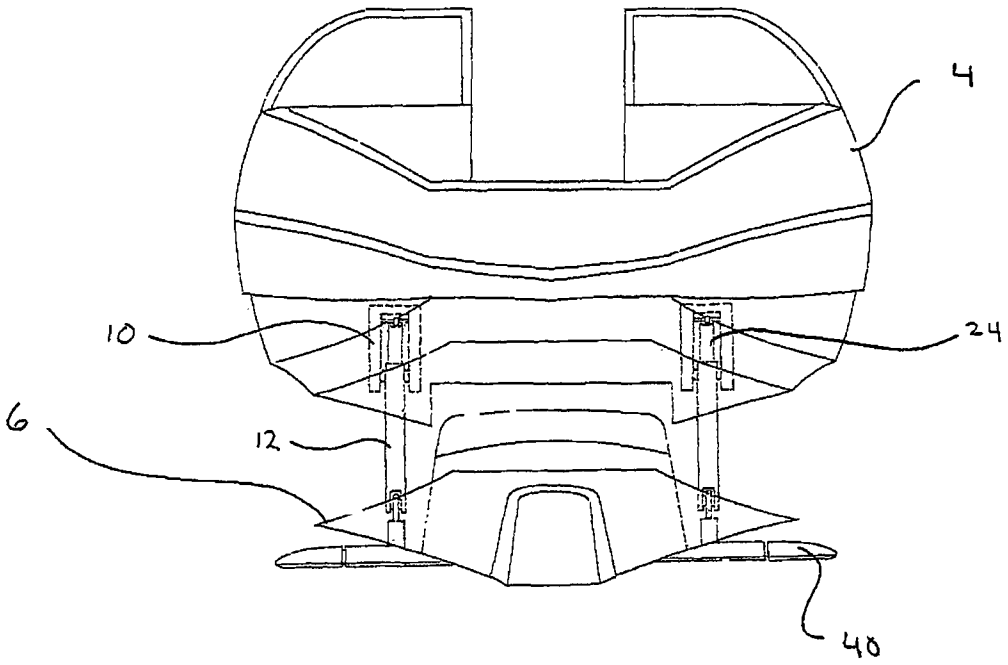
FIG. 4 is a front view of an inboard boat in the elevated position.
Figure 5:
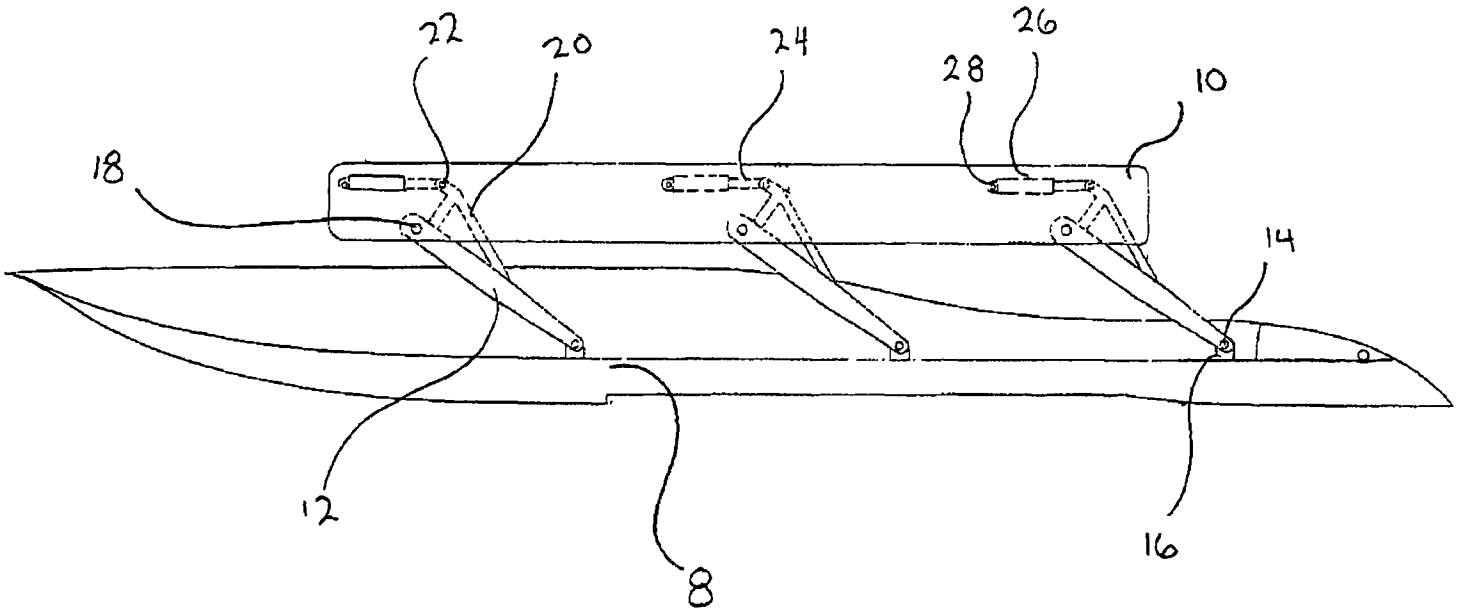
FIG. 5 is a side view of the suspension system.

Looking at FIGS. 4 and 5 it can be seen that the suspension system is comprised of an upper hull subframe 10 and a lower hull subframe 8 each rigidly mounted into their respective hull section 6 and body section 4. The subframes each lie along both sides of the boat in a mirrored configuration about the longitudinal centerline of the boat. The subframes may be of a U shaped configuration or may be comprised of two separate, mirrored image sections as is indicated in FIG. 5. There is a left and a right bank of substantially similar suspension swingarms 12 that reside with their longitudinal axis lying parallel to the longitudinal axis of the boat. The number and size of suspension swingarms 12 that are required in each bank vary with the length and weight of the boat. Each swingarm 12 is pivotally connected at its distal end by a lower stub axle 14 to a stanchion 16 that extends normally from the lower hull subframe 8. The proximate end of each swingarm 12 is pivotally connected by an upper stub axle 18 directly to a U shaped upper body subframe 10 (best shown in FIG. 4). Each swingarm 12 has a lift member 20 that rigidly extends normally from an upper surface thereof. The lift members 20 on the swingarms 12 are pivotally connected by first shock stub axle 22 to a first end of an extendible shock absorbing means 24 which has its second end 26 pivotally connected by a second shock stub axle 28 to the upper body subframe 10 (best shown in FIG. 5). The design and positioning of the lift members 20 is such to allow mechanical advantage to the pivotal raising of the swingarms 12, thereby reducing the amount of force to be exerted by the extendible shock absorbing means 24.

Figure 2:
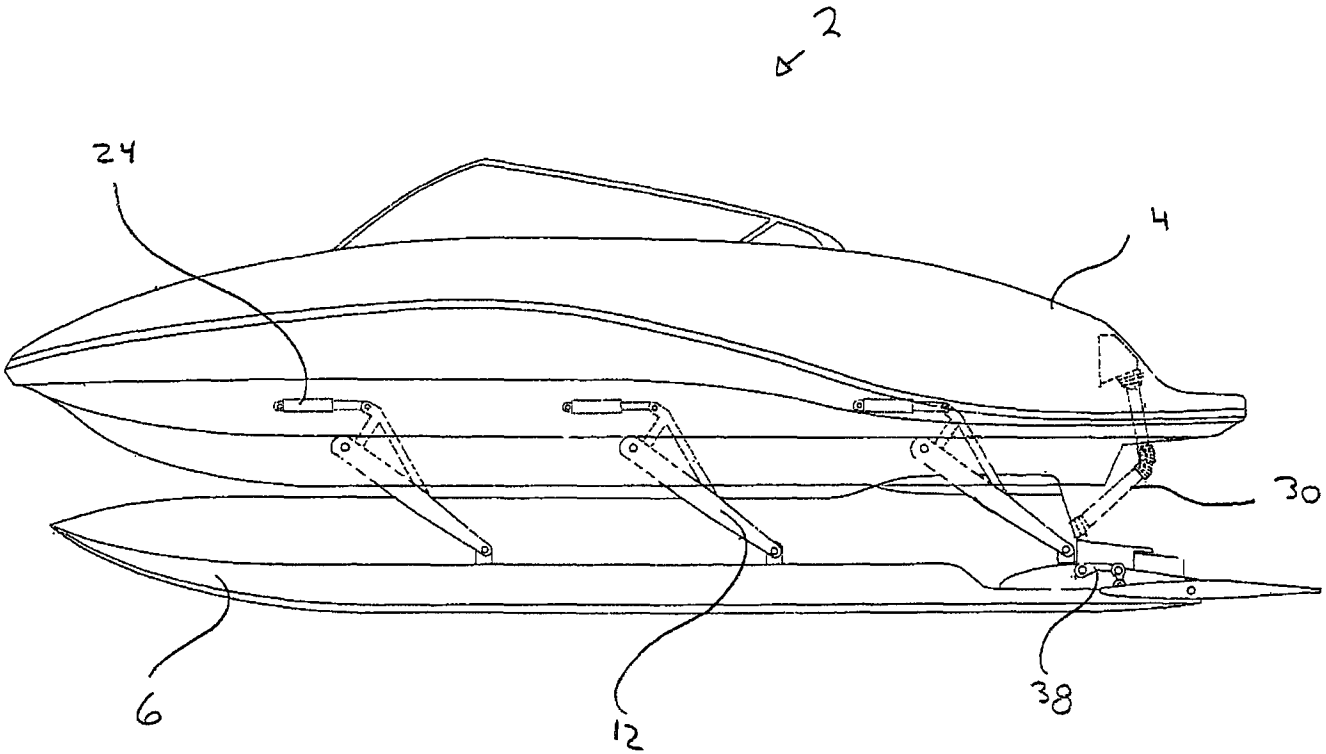
FIG. 2 is a side view of an inboard boat in the elevated position showing the general arrangement of the suspension system components.
Figure 3:
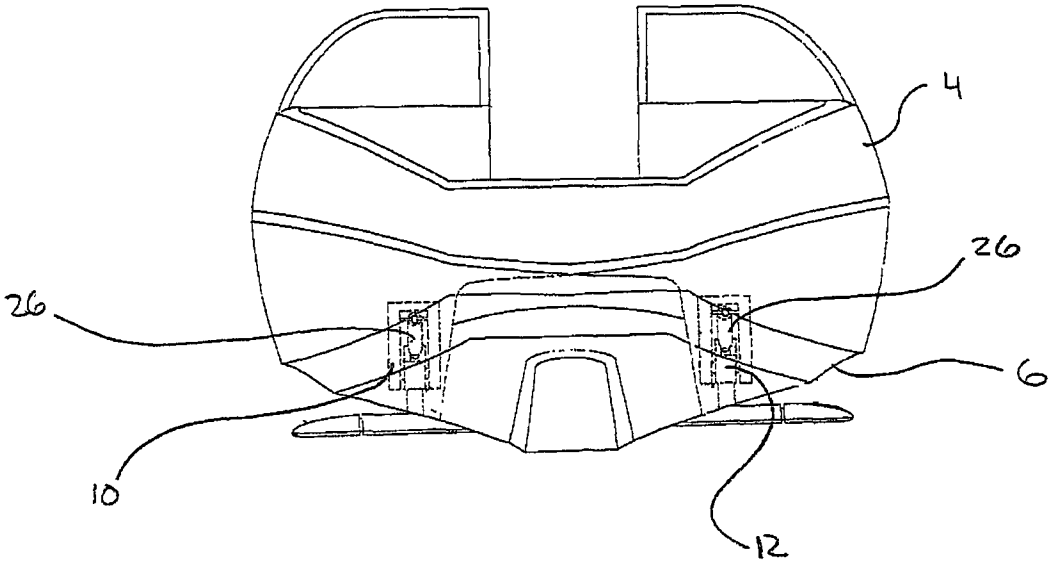
FIG. 3 is a front view of an inboard boat in the collapsed position.

In operation, looking at FIGS. 1 and 2, with their phantom representations of the suspension system, it can be seen that body section 4 may be extended or raised above the lower hull section 6. This extension is done pneumatically by the addition of pressurized gas from a pneumatic control unit simultaneously into each extendible shock absorbing means 24 in both the right and left banks. The pressurized shock absorbing means extend in length generating a force between the shock absorbing means front mounting point on the upper body subframe 10 and the shock absorbing means rear mounting point on the lift members 20 of the swingarms 12. This causes the body section 4 of the boat to rise vertically off of the hull section 6 of the boat 2. Once in this position any severe bumps experienced by the hull 6 will be partially dampened by movement of the shock absorbing means as the slower responding body section's weight will momentarily compress the gas in the shock absorbing means 24. The shock absorbing means 24 also act as a pneumatic shock absorber to somewhat dampen the pitch of the boat as waves pass along its longitudinal axis.

It is known that different boats have different weights and carry differing loads. Raising the suspension system to its full height will require much more effort on certain boats. For this reason the attachment points of either of the ends of the extendible shock absorbing means 24 may be adjusted somewhat on the body and hull subframes to alter the lifting angle and adjust the mechanical advantage. Requisite components that are attached to both the hull section 6 and the body section 4 such as lines, hoses and wiring will be protected in extendible shrouds not shown in drawings.

The pneumatic control units used to operate the suspension system are generally comprised of a compressor, a tank, a pressure gauge, and an actuator and have been well known in the industry for years and the details of their operation and the specific configuration and selection of their integral components do not comprise part of the present invention. For visual clarity the pneumatic control unit has been eliminated from the figures.

Note that while all of the pivotal connections on the subframes 8 and 10, the shock absorbing means 24, the lift members 20, and the swingarms 12, are described as being pivotally connected through the use of short stub axles 14, this may also be accommodated by linear axles 18 that tie the pivotal connections together between the two parallel sides or the two banks of suspension swingarms.

As can be seen comparing FIGS. 1 and 2 as the body section 4 is raised above the hull section 6, the body section 4 moves slightly back with respect to the hull section 6 by virtue of the operation of the tilting swingarms 12.

The advantage of the ability of the boat to raise its body section 4 above its hull section 6 is to allow a suspension system capable of handling the pitch, and a stabilization system capable of handling the pitch and tilt of the boat to be placed between the two sections of the boat.

Looking at FIGS. 1, 4, 6 and 7 it can best be seen that at the rear of the boat there are three flaps that are used to control the braking, steering and stabilization functions. These are all mounted and pivot about a common rear axle 36 oriented perpendicular to the longitudinal axis of the boat 2. The two elevons 40 and the elevator 42 are mounted on the axle 36 just slightly ahead of their axial center. Preferably the location of this axle 36 will be 18/42 of the flap's longitudinal length from the leading edge. This dimension has proven to be the best operational dimension however a deviation plus or minus 10% has been shown to be acceptable. Thus it will always take force to tilt any of the flaps' leading edges into the water. To tilt any flap further into the water will take increasing force since the surface area of each flap from its leading edge to the axis of tilt is less than the surface area from the axis of tilt to the trailing edge. As the moving water passes over the tilting flap more force acts upon the rear of the flap to try to keep the flap horizontal (or return it to a neutral position.) In this manner when under power, a rogue wave cannot grab the leading edge of any flap and pivot its position normal to the plane of forward motion of the boat, bringing it to an unexpected, abrupt stop. Although more water force is acting upon the rear of the flap and less water pressure is acting on the surface of the flap's leading edge, the exact location of the pivotal axis (positioned at 18/42 of the longitudinal length from the flaps leading edge) has been shown to reduce at least 40% of the pressure normally required from the hydraulic cylinders to move the flaps.

Figure 6:
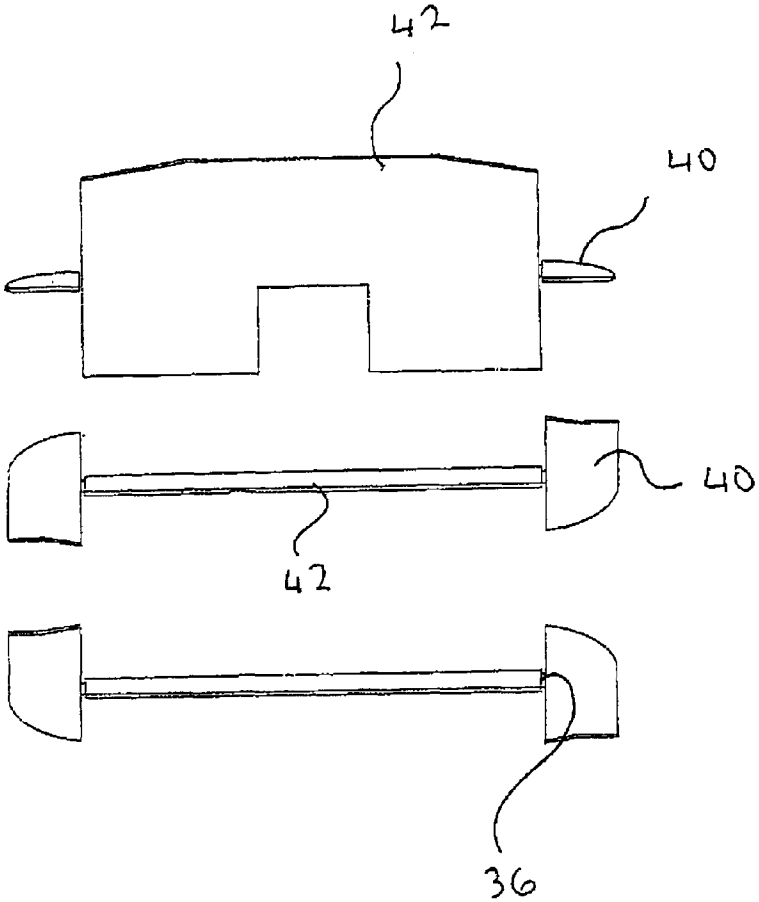
FIG. 6 is a rear view of three positionings of the suspension system steering and braking components.
Figure 7:
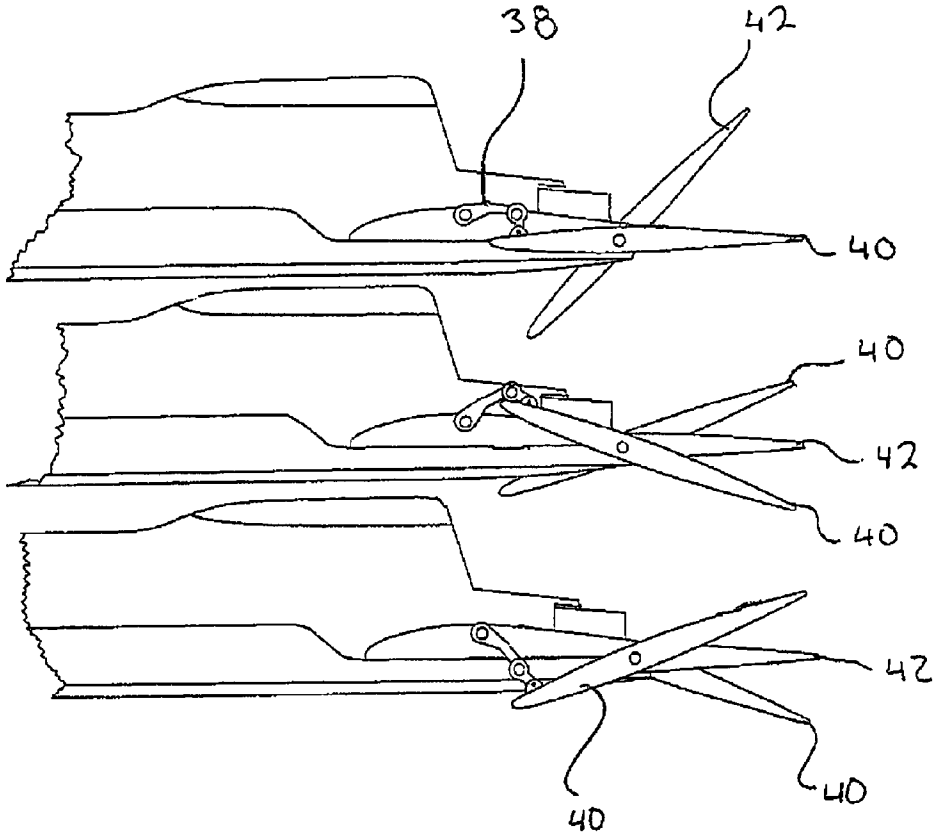
FIG. 7 is a side view of three positionings of the suspension system steering and braking components.
Figure 8:
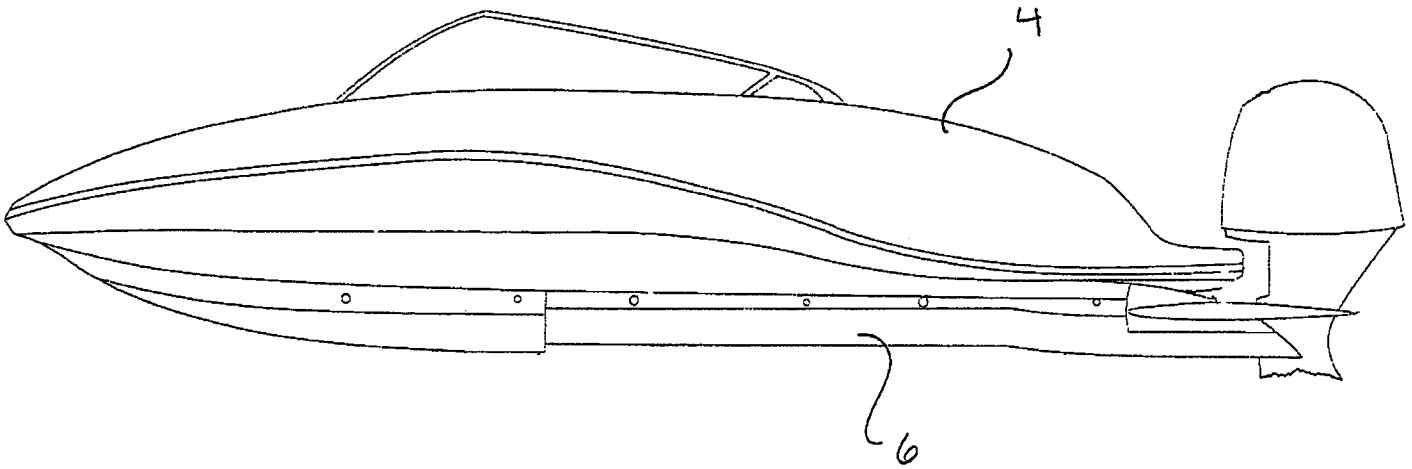
FIG. 8 is a side view of an outboard boat in the collapsed position showing the general arrangement of the suspension system components.
Figure 9:
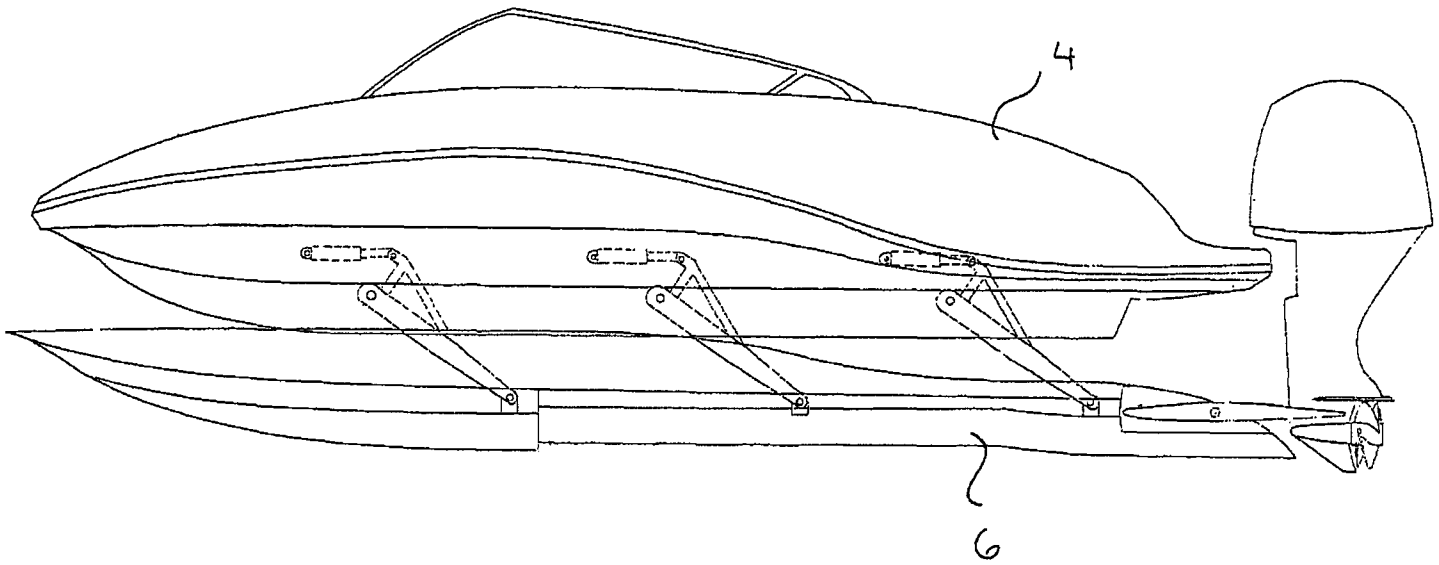
FIG. 9 a side view of an outboard boat in the elevated position showing the general arrangement of the suspension system components.
Figure 10:
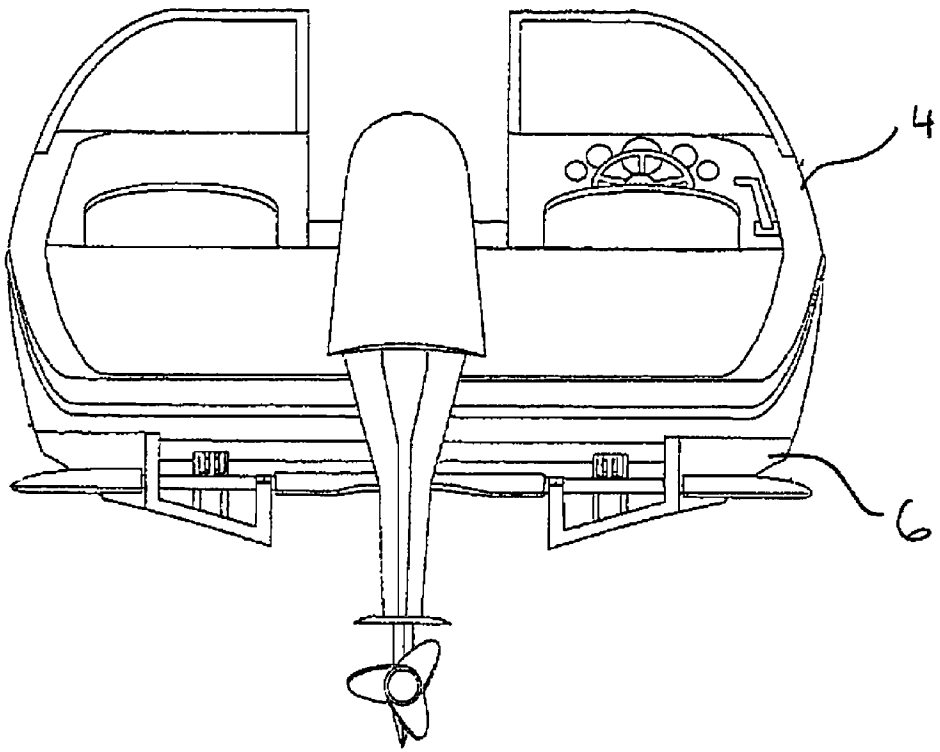
FIG. 10 is a rear view of an outboard boat in the collapsed position.
Figure 11:
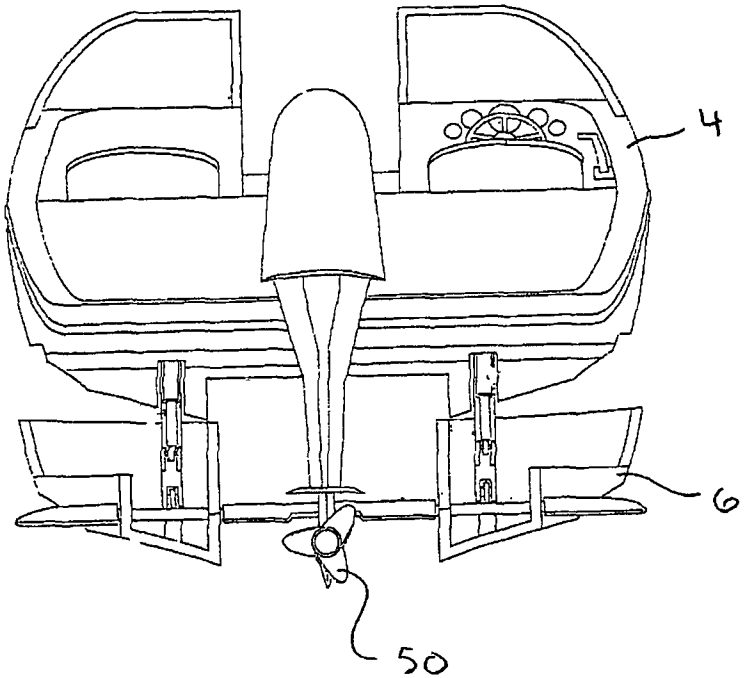
FIG. 11 is a rear view of an outboard boat in the elevated position.

The three flaps are controlled by three devices, the steering means (a steering wheel or joystick), the computerized gyroscope (for stability), and the brake pedal (for braking and enhanced turning.) Each of these three devices send a signal to a flap manipulation system. Physical movement (positioning) of the three flaps is by hydraulic manipulation although pneumatic and electric servo motor manipulation has been successfully tested and are acceptable substitutes that do not depart form the scope of the invention. Utilizing pneumatic control of the flaps eliminates the need for the hydraulic system as the existing pneumatic control unit for the pressurizing of the suspension system can be used for the steering and braking systems. Such positioning systems (hydraulic, pneumatic and electric) have been utilized in the mechanical field of aviation for years and the details of their operation and the specific configuration and selection of their integral components do not comprise part of the present invention. For visual clarity the hydraulic flap manipulation system has been eliminated from the figures although the flap linkage 38 can be seen in FIG. 2 while the positioning of the flaps with their corresponding flap linkage 38 configuration can best be seen in FIG. 7. The top (or A) illustrations of FIGS. 6 and 7 show the centrally located elevator 42 in a "full stop" or down position. The middle (or B) illustrations of FIGS. 6 and 7 show the elevons 40 in a right turn position, and the bottom (or C) illustrations of FIGS. 6 and 7 show the elevons 40 in a left turn position.

Although smaller or boats will generally only require the three rear mounted flaps, larger, performance boats may utilize an additional set of elevons 40 positioned towards the front of the hull section 6. FIG. 12 shows a tunnel boat hull section 6 with a set of forward elevons.

When under power, the steering means of the boat 2 enable the turning of the boat's propeller 50 at the rear of the boat 2 which redirects the thrust of the water pushed past the propeller to steer. Simultaneously, the elevons 40 all pivot (although in opposite fashion) and the elevator 42 dips slightly to frictionally engage the water surface and enhance the steering at power. The amount of movement of the elevons 40 and elevator 42 is proportional to the amount of steering means movement.

When the engine is shut off but the boat 2 is still moving forward, there is no thrust from the propeller 50 and there is a dramatic loss of the boat's steering and no braking. However, in the present invention the action of the elevons 40 and the elevator 42 in response to the steering means or brake pedal movement serve to continue the steering and braking functions, either independently or in unison.

The brake pedal controls the position of the elevator 42 and the forward and rear elevons 40. Depressing the brake pedal drives the leading edge of the elevator 42 down further into the water while simultaneously driving all four of the trailing edges of the forward and rear elevons 40 down further into the water regardless of what flap manipulations the steering means or the gyroscope are performing. The steering means counter pivot the forward and rear elevons 40 and slightly tilts the leading edge of the elevator 42. The computerized gyroscope rapidly counter pivots the two forward and rear elevons 40 in relation to the roll (rotation of the boat about its longitudinal axis) while the steering means remain within a specified number of degrees left or right of its neutral steering position. When a turn is being negotiated the steering means exceed this position and the gyroscope signal input to the hydraulic flap manipulation system is overridden.

Since the boat has a horizontal split between the hull section 6 and the body section 4 when in the elevated configuration the increased body section height enhances the motion experienced by the passengers as they are further from the axis of the roll, pitch and yaw of the passenger compartment as waves pass under the boat 2. Under power though, the boats's predominant motion is roll. Hence, the need for a stabilization system to minimize the side to side rocking. This is a accomplished by a computerized gyroscopic control unit located on or adjacent a lower surface of the hull section 6 that accomplishes a fast response to minimally tilt down the leading edge of the elevon 40 on the opposite side the boat is rocking towards and to simultaneously minimally tilt the trailing edge of the elevon 40 on the side the boat is rocking toward. These elevon actions will compensate for the roll of the boat when moving under power by counteracting the side to side forces. Essentially, the stabilization system's gyroscope continually adjusts the flaps when the boat is under power and traveling in a straight line, or under minimal steering so as to maintain a level position for the body section 4 of the boat 2 or a stable turn, BUT when making a sharp turn (once the steering means is moved beyond a certain position) the steering means position overrides any gyroscope control signal.

Also when under power and encountering rough water conditions, the boat will also pitch (the up and down rocking motion of the boat's bow and stern.) Here the computerized, gyroscopic, stabilization control unit of the stabilization system acts to minimize the up and down rocking of the boat's bow and stern. This gyroscope accomplishes a fast response to accordingly tilt down or up the leading edges of the forward elevons 40 in unison. Furthermore, at the rear of the boat the elevator 42 is simultaneously being controlled by the computerized gyroscope control unit in a fast down and up motion to minimize pitch.

When the bow of the boat 2 is tilting down and the stern of the boat is tilting up the two leading edges of the forward elevons 40 accordingly tilt up creating an upward lift to the bow of the boat 2 and therefore minimizing the bow's downward movement. Simultaneously, the leading edge of the elevator 42 at the rear of the boat accordingly tilts down creating a downward movement at the stern of the boat and therefore minimizing the stern's upward movement and the boat's overall pitch motion.

When the bow of the boat 2 is tilting up and the stern of the boat 2 is tilting down the two leading edges of the forward elevons 40 accordingly tilt down creating a downward movement to the bow of the boat and therefore minimizing the bow's upward lift. Simultaneously the leading edge of the elevator 42 at the rear of the boat 2 accordingly tilts up creating an upward lift at the stern of the boat and therefore minimizing the stern's downward movement and the boat's overall pitch motion.

When the computerized, gyroscope, stabilization, control system is controlling the pitch of the boat 2 the forward elevons 40 and the elevator 42 operate opposite each other at all times, but in unison to minimize the pitch motion. It is to be noted that the computerized, gyroscopic, stabilization control unit of the stabilization system acts actually employs two gyroscopes, one to stabilize the pitch and one to stabilize the roll. In other words, the elevon 40 and elevator 42 actions will compensate for the pitch of the boat 2 when moving under power by counteracting the up and down forces of the bow and stern. Essentially, the stabilization system's gyroscopic control unit continually adjusts the flaps when the boat is under power and traveling in a straight line, or under minimal steering so as to maintain a level position for the body section 4 of the boat 2 or a stable turn.

The boat 2 is operated by a joystick or steering wheel, but in the use of a joystick the operator of the watercraft can manually raise the bow of the boat by simply pulling back on the joystick or lower the bow of the boat by pushing forward on the joystick. When the operator is manually pushing forward on the joystick the elevator 42 at the rear of the boat 2 accordingly tilts the leading edge up creating an upward lift at the stern of the boat 2 while the leading edge of the two forward elevons 40 accordingly tilt down creating an downward movement at the bow of the boat 2.

When the operator is manually pulling back on the joystick the elevator 42 at the rear of the boat 2 accordingly tilts the leading edge down creating an downward movement at the stern of the boat while the leading edge of the two forward elevons 40 accordingly tilt upward creating an upward lift to the bow of the boat 2. However, when using the joystick to raise or lower the bow and stern (once the joystick means is moved beyond a certain position) the joystick means position overrides any gyroscope control signal that is used to stabilize the pitch and roll.

Therefore the operator of the watercraft has full control of the pitch and roll by manipulating the joystick left to right or forward and back to move the control surfaces of the elevons 40 and elevator 42 accordingly. The joystick and control surfaces are used in the same way that a fighter pilot controls a fighter jet in the air therefore, the joystick and control surfaces on this watercraft are designed to control the watercraft even as it travels long distances through the air when encountering large swells.

It is to be noted that in a boat, because of the physical dynamics of its design, there is no need for the computerized gyroscope to control the yaw (side to side tilting of the boat about its longitudinal axis.) As such, an acceptable substitute for the computerized gyroscope would be a simple computerized tilt meter that sends out a signal to the hydraulic flap manipulation system may be used. This is well capable of controlling the pitch and roll component of the boat. Computerized gyroscopic systems and tilt meters for the positioning of moveable means by hydraulic, pneumatic or electric actuators have been utilized in numerous mechanical fields of endeavor for years and the details of their operation and the specific configuration and selection of their integral components do not comprise part of the present invention. For visual clarity the gyroscope and or tilt meter has been eliminated from the figures. The movement of the various elements as described above are best illustrated in FIGS. 6 and 7 with reference to the following chart. The positioning of the front elevons 40 are indistinguishable.

Positions of Steering Stabilization System Elements with Applied Function (describes the position WRT the leading edges)

| | Elevon Position | | Elevator |
|---|---|---|---|
| Applied Function | L Elevons | R Elevons | Position |
| braking (with foot pedal) | up | up | down |
| turn right (w joystick or steering wheel) | up | down | min down |
| turn left (w joystick or steering wheel) | down | up | min down |
| simultaneous braking & turning | see above direction | see above direction | down |
| stabilizing function (gyroscope tilt controls as boat rolls to left) | up | down | no movement |
| stabilizing function (gyroscope tilt controls as boat rolls to right) | down | up | no movement |

The ability to make the boat 2 perform a trick maneuver is enhanced since the operator can now control the braking, the altitude of the boat and intensity of the turn, which heretofore has not been done in a boat 2.

The above description will enable any person skilled in the art to make and use this invention. It also sets forth the best modes for carrying out this invention. There are numerous variations and modifications thereof that will also remain readily apparent to others skilled in the art, now that the general principles of the present invention have been disclosed. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The invention claimed is:

1. A boat with a reactive suspension system with integrated braking and steering systems comprising:

an upper hull section housing said boat's operational controls and passenger compartment;

a lower hull section housing a propulsion system;

a reactive suspension system connecting and dispersed between said upper hull section and said lower hull section;

at least one upper subframe rigidly affixed to said upper hull section;

at least one lower subframe rigidly affixed to said lower hull section;

a first pressurized actuation system;

at least one pair of rigid swingarms; and at least one pair of shock absorbers each having a distal end pivotally connected to said upper subframe and each having a proximate end pivotally connected to one of said pair of swingarms;

wherein said suspension system vertically separates said lower hull from said upper hull and conjoins said hulls into a unitary hull configuration;

and wherein said upper subframe and said lower subframe each lie in a mirrored configuration on both sides of a longitudinal centerline of said boat;

and wherein said rigid swingarms have a first end pivotally connected to said upper subframe and have a second end pivotally connected to said lower subframe;

wherein said first pressurized actuation system is in operational connection with said shock absorbers so as to increase or decrease the distance between said distal ends and proximate ends thereby separating or conjoining said upper hull section from said lower hull section.

2. The boat of claim 1 wherein said swingarm has a lift member extending normally therefrom and is pivotally connected to said proximate end of said shock absorber.

3. The boat of claim 2 wherein said pair of swingarms consist of two similar swingarms mounted in a parallel configuration equidistant from the longitudinal centerline of said boat, and said pair of shock absorbers consist of two similar shock absorbers mounted in a parallel configuration equidistant from the longitudinal centerline of said boat.

4. The boat of claim 3 wherein said reactive suspension system further comprises:

a second actuation system;

at least three flaps; and a computerized gyroscopic system;

wherein said gyroscopic system is in electronic communication with said second actuation system to initiate movement of said flaps based on the roll and pitch of said boat.

5. The boat of claim 1 wherein said pressure actuation system is a pneumatic system.

6. The boat of claim 1 wherein said pressure actuation system is a hydraulic system.

7. The boat of claim 4 wherein said three flaps each having a leading edge and a trailing edge and an axle passing axially through all three flaps at a location forward of each flap's axial midline; wherein said flaps are pivotally mounted at a rear section of said lower hull, having a central elevator flap flanked by an elevon flap on either side.

8. The boat of claim 7 wherein said second actuation system pivotally maneuvers said three flaps' leading edges vertically with respect to the horizontal axis of the boat to steer or brake said boat.

9. The improved personal boat of claim 8 wherein said gyroscope is a two directional level sensing control means operationally connected to said second actuation system to automatically operate said elevons and said elevator in unison to stabilize said boat in response to a roll or pitch motion experienced by said boat.

10. A boat with a reactive suspension system with integrated braking and steering systems comprising:

an upper hull section housing said boat's operational controls and passenger compartment;

a lower hull section housing a propulsion system;

a reactive suspension system connecting and dispersed between said upper hull section and said lower hull section;

at least one upper subframe rigidly affixed to said upper hull section;

at least one lower subframe rigidly affixed to said lower hull section;

a first pressurized actuation system;

at least one pair of shock absorbers each having a distal end pivotally connected to said upper subframe;

at least one pair of rigid swingarms having a lift member extending normally therefrom and pivotally connected to a proximate end of said shock absorber;

a second actuation system;

at least three flaps each having a leading edge and a trailing edge and an axle passing axially through all three flaps at a location forward of each flap's axial midline;

a computerized gyroscopic system;

a foot actuated brake pedal; and a steering joystick;

wherein said suspension system vertically separates said lower hull from said upper hull and conjoins said hulls into a unitary hull configuration; and wherein said upper subframe and said lower subframe each lie in a mirrored configuration on both sides of a longitudinal centerline of said boat; and wherein said rigid swingarms have a first end pivotally connected to said upper subframe and having a second end pivotally connected to said lower subframe; and wherein said first pressurized actuation system is in operational connection with said shock absorbers so as to increase or decrease the distance between said distal ends and proximite ends thereby separating or conjoining said upper hull section from said lower hull section; and wherein said pair of swingarms consist of two similar swingarms mounted in a parallel configuration equidistant from the longitudinal centerline of said boat, and said pair of shock absorbers consist of two similar shock absorbers mounted in a parallel configuration equidistant from the longitudinal centerline of said boat; and wherein said gyroscopic system is in electronic communication with said second actuation system to initiate movement of said flaps based on the roll and pitch of said boat; and wherein said flaps are pivotally mounted at a rear section of said lower hull, having a central elevator flap flanked by an elevon flap on either side; and wherein said second actuation system pivotally maneuvers said three flaps' leading edges vertically with respect to said longitudinal centerline of the boat to steer or brake said boat;

wherein said gyroscope is a two directional level sensing control means operationally connected to said second actuation system to automatically operate said elevons and said elevator in unison to stabilize said boat in response to a roll or pitch motion experienced by said boat; and wherein said brake pedal is operationally connected to said actuation system to cause said elevator leading edge to move vertically without any corresponding movement of said elevons to brake said boat, and wherein said joystick is operationally connected to cause said elevon leading edges to move in opposite vertical directions simultaneously and cause said elevator leading edge to move vertically downward to steer said boat.

* * * * *